US012392343B2

(12) United States Patent
Nohales Herraiz et al.

(10) Patent No.: US 12,392,343 B2
(45) Date of Patent: Aug. 19, 2025

(54) THERMAL DEFORMATION MANAGEMENT IN A STATIONARY SCROLL PLATE OF A SCROLL COMPRESSOR

(71) Applicant: Copeland Europe GmbH, Berlin (DE)

(72) Inventors: Jesús Ángel Nohales Herraiz, Welkenraedt (BE); Xiaogeng Su, Welkenraedt (BE); Marco Alonso Cardenas-Ruiz, Welkenraedt (BE); Matus Haluska, Welkenraedt (BE)

(73) Assignee: Copeland Europe GmbH, Berlin (DE)

( * ) Notice: Subject to any disclaimer, the term of this patent is extended or adjusted under 35 U.S.C. 154(b) by 436 days.

(21) Appl. No.: 17/848,354

(22) Filed: Jun. 23, 2022

(65) Prior Publication Data

US 2022/0412362 A1 Dec. 29, 2022

(30) Foreign Application Priority Data

Jun. 23, 2021 (EP) ..... 21181151

(51) Int. Cl.
*F04C 18/02* (2006.01)
*F04C 18/26* (2006.01)
(Continued)

(52) U.S. Cl.
CPC ..... *F04C 29/042* (2013.01); *F04C 18/0215* (2013.01); *F04C 18/0253* (2013.01)

(58) Field of Classification Search
CPC ..... F04C 29/042; F04C 29/0007; F04C 18/0215; F04C 18/0253; F04C 18/0261
See application file for complete search history.

(56) References Cited

U.S. PATENT DOCUMENTS 3,986,799 A 10/1976 McCullough
5,044,904 A * 9/1991 Richardson, Jr. ... F04C 18/0215 29/525.08
(Continued)

FOREIGN PATENT DOCUMENTS

CN 109268270 A 1/2019
EP 0579374 A1 1/1994
(Continued)

OTHER PUBLICATIONS

Extended European Search Report issued in European Patent Application No. 21181151.8, dated Dec. 14, 2021.

*Primary Examiner* — Deming Wan
(74) *Attorney, Agent, or Firm* — Harness, Dickey & Pierce, P.L.C.

(57) ABSTRACT

A stationary scroll plate for use in a scroll compressor is described. The stationary scroll plate comprises a base plate having a first side and a second side, wherein the second side opposes the first side; a spiral wrap formed at the first side of the base plate, wherein the spiral wrap is adapted to interact with a corresponding spiral wrap of an orbiting scroll plate to form a compression chamber; an injection channel formed within the base plate, the injection channel providing an injection path for injection of fluid into the compression chamber; a recess located at the second side; an insert placed within the recess, wherein the insert forms a cooling chamber within the recess; an inlet channel via which the cooling chamber is connected to the injection channel; and an outlet channel via which the cooling chamber is connected to the inside of the spiral wrap.

15 Claims, 15 Drawing Sheets

(51) Int. Cl.
*F04C 29/00* (2006.01)
*F04C 29/04* (2006.01)

(56) References Cited

U.S. PATENT DOCUMENTS

| | | | | |
|---|---|---|---|---|
| 6,267,565 | B1 * | 7/2001 | Seibel | F04C 28/28 62/196.3 |
| 2006/0198748 | A1 * | 9/2006 | Grassbaugh | F04C 27/005 418/55.6 |

FOREIGN PATENT DOCUMENTS

| | | | |
|---|---|---|---|
| JP | H03253791 | A | 11/1991 |
| WO | 9508713 | A1 | 3/1995 |

* cited by examiner

THERMAL DEFORMATION MANAGEMENT IN A STATIONARY SCROLL PLATE OF A SCROLL COMPRESSOR

CROSS-REFERENCE TO RELATED APPLICATION

This application claims priority to European Application No. 21181151.8 dated Jun. 23, 2021, the entire disclosure of which is incorporated herein by reference.

FIELD

The current application relates to a stationary scroll plate for use in a scroll compressor, wherein such compressor could be used, for example, in refrigeration systems as well as a scroll compressor comprising such a stationary scroll plate.

BACKGROUND

A compressor is an apparatus, which reduces the volume of a fluid by increasing the pressure of the fluid.

Compressors are used, for example, in refrigeration systems. In a common refrigeration system, a refrigerant is circulated through a refrigeration cycle. Upon circulation, the refrigerant undergoes changes in thermodynamic properties in different parts of the refrigeration system and transports heat from one part of the refrigeration system to another part of the refrigeration system. The refrigerant is a fluid, i.e. a liquid or a vapour or gas. Examples of refrigerants may be artificial refrigerants like fluorocarbons. However, in recent applications, the use of carbon dioxide, $CO_2$, which is a non-artificial refrigerant, has become more and more important, because it is non-hazardous to the environment.

A compressor comprises at least a suction port, a discharge port, and a means for compressing. At the suction port, the compressor receives the fluid, which is to be compressed. In case the compressor is used in a refrigeration system, the fluid is a refrigerant. At the suction port, the fluid usually is in a gaseous or vapour state. The means for compressing is used for compressing the fluid from an initial pressure, for example the pressure the fluid has at the suction port, to a desired discharge pressure. For example, the means for compressing may form at least one compression chamber. A compression chamber is a closed volume, in which a portion of the refrigerant will be compressed. Afterwards, the compressed fluid is discharged at the discharge port. In a scroll compressor, the means for compressing comprises two scroll plates, which form the at least one compression chamber. One of these scroll plates is a stationary scroll plate and the other scroll plate is an orbiting scroll plate, which is moved in an orbiting motion relatively to the stationary scroll plate. Both scroll plates usually comprise corresponding spiral wraps, which are interleaved, when the elements of the scroll compressor are assembled. The interleaved spiral wraps and the base plates form the at least one compression chamber. Due to the orbiting motion of the orbiting scroll plate, fluid is drawn into a pocket formed between the spiral wraps. Said pocket forms a compression chamber and is transported from the outermost locations of the interleaved spiral wraps to the innermost locations of the interleaved spiral wraps. Thereby, the fluid within the pocket is moved to the innermost locations of the interleaved spiral wraps. During this process, the fluid will be compressed because the size of the pocket, i.e. the size of the compression chamber, will be reduced. At the innermost location of the interleaved spiral wraps, the compressed fluid will be ejected from the compression chamber into a discharge chamber of the compressor, from where the compressed fluid will be discharged from the compressor at the discharge port. The person skilled in the art will appreciate that during operation of a scroll compressor, while one compression chamber, which is formed by a pocket between the interleaved spiral wraps and the base plates of the scroll plates, is moved to the innermost location, one or more additional compression chambers may be formed subsequently upon further relative motion of the scroll plates.

During the compression of the fluid within the compression chambers, the fluid's pressure and temperature increase. This increase in temperature of the fluid also increases the temperature of the scroll plates, which form the one or more compression chambers, due to the contact between the scroll plates and the fluid. Additionally, friction losses caused by the motion of the orbiting scroll plate also increase the temperature of the scroll plates. However, only one side of each scroll plate is directly affected by the temperature increase within the at least one compression chamber, namely the side of the scroll plate, which comprises the spiral wrap and which faces the respective other scroll plate. For purposes of this invention disclosure, said side is referred to as frontside of the scroll plate, whereas the side of each scroll plate, which opposes its frontside is referred to as backside of the scroll plate. Accordingly, a substantial temperature difference may develop between the backside of the scroll plate and the frontside, which comprises the spiral wrap.

In the art, different scroll compressor configurations are known, which operate at different pressure ranges and temperatures. For example, one configuration comprises a low-pressure side and a high-pressure side. The low-pressure side may comprise a suction port, a motor and a crankshaft for operating the scroll compressor as well as a lubricant supply, whereas the high-pressure side comprises the discharge port. According to said definition, the scroll set is neither part of the low-pressure side nor part of the high-pressure side, but instead forms a transition area between both sides. Additionally, the stationary scroll plate may at least partially be in contact to the high-pressure side and/or the orbiting scroll plate may at least partially be in contact to the low-pressure side. In said low-pressure side and high-pressure side configuration, the fluid is received at a suction port at the low-pressure side, will be compressed in the at least one compression chamber formed by the scroll plates and will then be provided to the high-pressure side. The person skilled in the art will appreciate that deviations from said definition of the low-pressure side high-pressure side configuration may be possible without deviating from the scope of the current application.

At the low-pressure side, the temperature of the fluid and the surrounding components is rather low. For example, the temperature may be similar to the temperature the fluid has, when it is received at the suction port. The temperature of the fluid received at the suction port may be referred to as fluid intake temperature. However, it is also possible that the temperature at the low-pressure side is higher than the temperature of the fluid received at the suction port, for example, because of the operation of the motor and the friction between the motor, crankshaft and the orbiting scroll plate. Therefore, the temperature of the fluid at the low-pressure side may be referred to as suction side temperature, because it refers to the temperature at the side of the compressor, which comprises the suction port. The suction side temperature may be similar to the fluid intake temperature or in case of, for example, heat generation by the operation of the motor and friction losses, the suction side temperature may be higher than the fluid intake temperature. The person skilled in the art will be aware that the suction side temperature does not represent a particular temperature value, but instead may represent a temperature interval. Said temperature interval may have the fluid intake temperature as a lower end, while its upper end depends on the operation of the compressor and the heat, which may be generated by the motor and the friction caused by movement of the crankshaft and the scroll plates. Typically, the upper end is less than or equal to the temperature at which the fluid will be discharged from the compressor at the discharge port Due to the temperature increase during the compression process, the temperature of the fluid and of the components of the high-pressure side is higher than the temperature at the low-pressure side, i.e. the suction side temperature. Since this higher temperature relates to the temperature at which the compressed fluid will be discharged from the discharge port, this higher temperature may be referred to as discharge temperature.

Consequently, the temperature of the fluid in the at least one compression chamber is in a range between the low temperature referred to as suction side temperature and the high temperature referred to as discharge temperature. The temperature within the at least one compression chamber is referred to as compression chamber temperature. Since the at least one compression chamber receives the fluid from the low-pressure side with the suction side temperature and because the temperature increases during compression, the compression chamber temperature represents an interval, which may have a range from the suction side temperature to the discharge temperature. In scroll compressor having a low-pressure side and a high-pressure side configuration, there are therefore different temperature areas. The exemplary temperature areas of such a scroll compressor configuration are described in more detail below with respect to FIG. 2.

In such a low-pressure side and high-pressure side configuration, the backside of the orbiting scroll plate may be in contact to the low temperature area operating at the suction side temperature, whereas the frontside of the orbiting scroll plate is in contact to the compression chambers and experiences the compression chamber temperature, which is higher than the suction side temperature in at least some locations within the interleaved scroll plates. In this case, there is a temperature difference between the frontside and the backside, wherein the temperature difference is a temperature difference of the suction side temperature and the compression chamber temperature. As the person skilled in the art will appreciate, the temperature distribution at the frontside of the orbiting scroll plate may be inhomogeneous, because the compressed refrigerant in the innermost locations of the spiral wrap has a higher temperature than the refrigerant in the outermost locations of the spiral wrap, which essentially has the temperature of the refrigerant received from the low-pressure side. Also, the temperature distribution at the backside of the orbiting scroll plate may be inhomogeneous, because some portions of the backside may be supported by a frame or a thrust plate and may experience friction, which also may increase the temperature locally, while other portions may be affected by lubricant. These effects may contribute to the temperature difference between the frontside of the orbiting scroll plate and the backside of the orbiting scroll plate.

For the stationary scroll plate, the temperature difference is different. As the person skilled in the art will appreciate, there are different ways in which the stationary scroll plate may be placed within the scroll compressor. In some examples, the backside of the stationary scroll plate may be in direct contact with the high-pressure side and may experience the discharge temperature, while in other examples another component or a portion of the case may provide a boundary between the stationary scroll plate and the high-pressure side, so that the temperature at the backside of the stationary scroll plate may be substantially lower than the discharge temperature. However, in most applications, the backside of the stationary scroll plate experiences a temperature which is higher than the suction side temperature—for example caused by heat transfer from the high-pressure side.

In contrast, the frontside of the stationary scroll plate experiences the compression chamber temperature, or in other words, the temperature of the fluid within the compression chamber. As mentioned above, the compression chamber temperature represents a temperature range between the suction side temperature and the discharge temperature. As the person skilled in the art will appreciate, in the innermost section of the spiral wraps from where the compressed fluid will be ejected into the discharge chamber, the compressed fluid has a temperature which may be similar to the discharge temperature, or in other words, the high temperature that the stationary scroll plate experiences at its backside. At the outer portions of the interleaved spiral wraps, i.e. the positions where the compression of the fluid is starting, the temperature may be similar to the suction side temperature. This may make the temperature distribution at the frontside inhomogeneous. Therefore, for the stationary scroll plate, there is a substantial temperature difference between the discharge temperature at the backside and the compression chamber temperature at the frontside, which increases from the suction side temperature at the outermost locations of the spiral wraps to the higher temperature of the compressed refrigerant at the innermost locations of the spiral wraps.

In another configuration, which is referred to as high-side configuration, both scroll plates are surrounded by the very high temperature discharge fluid. In such a case, the stationary scroll plate as well as the orbiting scroll plate each at least locally experience a temperature difference between the discharge temperature and the at least locally lower compression chamber temperature. The person skilled in the art is aware that the principles of the current disclosure may also be exercised in such a compressor having a high-side configuration, although the detailed description concentrates on a low-pressure side and high-pressure side scroll compressor configuration.

In any configuration, the temperature difference leads to differences in thermal expansion and therefore stress and deformation induced onto the scroll plate. Such effects may lead to leakage or decreased efficiency of the scroll compressor.

Hence, there is a need in the art for reducing thermal deformation of scroll plates in a scroll compressor.

The above-mentioned need is fulfilled by a stationary scroll plate according to the current invention. The stationary scroll plate according to the current invention may be for use in a scroll compressor.

SUMMARY

A stationary scroll plate according to of the current invention comprises a base plate. The base plate has a first side and a second side, wherein the second side opposes the first side. The first side may be referred to as frontside of the scroll plate, whereas the second side may be referred to as backside of the scroll plate. A spiral wrap is formed at the first side of the base plate. The spiral wrap is adapted to interact with a corresponding spiral wrap of another scroll plate, in particular an orbiting scroll plate. Between the spiral wraps and the base plates of both scroll plates, one or more compression chambers may be formed. By orbiting motion of at least the orbiting scroll plate, the fluid in the compression chamber is compressed.

The stationary scroll plate also comprises an injection channel, which is formed within the base plate. The injection channel provides an injection path for injection of fluid into the compression chamber formed between the spiral wrap of the base plate and the corresponding spiral wrap of the orbiting scroll plate. Accordingly, at the end of the injection channel, an opening may be located, which may be used to connect the injection channel with an injection line of a refrigeration cycle. The injection channel can be used to inject fluid—e.g. taken from a refrigeration cycle—into the compression chambers formed between the corresponding spiral wraps. Just as an example, the injected fluid may be taken from an economizer or a flash tank of a refrigeration cycle. The fluid may be injected at intermediate pressure. In this regard, the intermediate pressure refers to a pressure higher than the pressure of the fluid at the suction port, but lower than the pressure of the fluid at the discharge port. The temperature of the injected fluid may be lower than the discharge temperature. Preferably, the temperature of the injected fluid may be an intermediate temperature, i.e. a temperature higher than the suction side temperature, but lower than the discharge temperature. However, in other preferred embodiments, it may also be possible that the temperature of the injected fluid is even lower than the suction side temperature.

Further, the stationary scroll plate comprises a recess. The recess is located at the second side of the base plate. Also, the stationary scroll plate comprises an insert. The insert is placed within the recess at the second side of the base plate of the stationary scroll plate. Thereby, the insert forms a cooling chamber within the recess. In other words, the insert separates the volume within the recess into two cavities. The first cavity forms the cooling chamber and may be located at the bottom of the recess, while other cavity, which is the remainder of the volume within the recess, may be used to form an intermediate pressure cavity as is described below. Said other cavity may be an open cavity and may be closed when the stationary scroll plate is assembled in a scroll compressor.

The stationary scroll plate further comprises an inlet channel and an outlet channel. Via the inlet channel, the cooling chamber is connected to the injection channel and via the outlet channel, the cooling chamber is connected to the inside of the spiral wrap. The connection of the cooling chamber with the inlet channel may be achieved by one or more first openings of the cooling chamber and the connection of the cooling chamber with the outlet channel may be achieved by one or more second openings of the cooling chamber. Accordingly, the cooling chamber is configured to receive a portion of the fluid from the injection channel via the inlet channel and—after the received fluid passed through the cooling chamber—the cooling chamber provides the fluid to one or more compression chambers, which are formed between the interleaved spiral wraps, via the outlet channel.

As mentioned earlier, the fluid in the injection channel has an intermediate temperature, which is lower than the discharge temperature. Therefore, during operation the cooling chamber will have a lower temperature than the backside of the stationary scroll plate. Accordingly, areas located in close proximity to the cooling chamber will be cooled by the intermediate temperature fluid. Preferably, the location of the recess and thereby the location of the cooling chamber is selected in a way that large areas of the stationary scroll plate can be cooled. This reduces stress and thermal deformation induced by the temperature difference and heat transfer between the backside and the frontside of the stationary scroll plate.

Further, the remaining volume of the recess, i.e. the volume that does not form the cooling chamber, may be used to provide an intermediate pressure cavity. When assembled in a scroll compressor, such an intermediate pressure cavity may be formed between the remainder of the recess of the stationary scroll plate and a portion of the case of the compressor, e.g. a plate to which the stationary scroll plate is fixed. The intermediate pressure cavity may be connected to one or more compression chambers formed between the spiral wraps of the scroll plate by ease of a so-called bleed hole. Thereby, pressure is built within the intermediate pressure cavity located at the second side of the stationary scroll plate, which presses the stationary scroll plate towards the orbiting scroll plate and improves the fit between the scroll plates. Furthermore, the intermediate pressure cavity and the bleed hole improve pressure balancing of the compression chambers. The person skilled in the art will appreciate that the bleed hole may be formed by a passage from the intermediate pressure cavity to one or more compression chambers, while there is no connection between said passage and the injection channel.

In a preferred embodiment, the recess located at the second side may have an annular shape. Further preferred, the center of the annular recess may be concentric with the center of the base plate. As mentioned before, the recess provides an intermediate pressure cavity, which can be used to push the stationary scroll plate towards the orbiting scroll plate and improve the fit between the interleaved spiral wraps. In case of an annular recess, the stationary scroll plate is pushed towards the orbiting scroll plate uniformly. In case of an annular recess, the insert placed within the recess may form the chamber in at least a portion of the annular recess. Preferably, the insert may also have an annular shape and may form the cooling chamber over the entire annular recess. In such a configuration, the injected fluid may flow through the entire annular cooling chamber and provide cooling to a large portion of the base plate.

In some preferred embodiments, the cooling chamber, the inlet channel and the outlet channel may define a cooling path configured to guide fluid received from the injection channel to the inside of the spiral wrap. This may be achieved by providing the first and second openings of the cooling chamber, that are used to connect the cooling chamber to the inlet and outlet channels, at opposing ends of the chamber. Further, the insert may form the cooling chamber in a way that the chamber provides a cooling path arranged in a predetermined way through the base plate. For example, in case of an annular shape of the insert and the cooling chamber, the first and second openings that connect the cooling chamber to the inlet and outlet channels may be provided at opposing sides of the annular chamber. In this regard, opposing sides of an annular chamber may be represented by any two locations of the annular chamber that can be connected by lines drawn through the center of the circle enclosed by the annular recess. As an example, the opening for the inlet channel may be provided at a location corresponding to 12 o'clock, while the outlet channel may be provided at a location corresponding to 6 o'clock.

The person skilled in the art will appreciate that in some embodiments, fluid may flow from the injection channel via the inlet channel to the cooling chamber and then via the outlet channel directly to the inside of the spiral wrap, whereas in other embodiments, the fluids may flow from the cooling chamber via the outlet channel back to the injection channel and then to the inside of the spiral wrap. In the latter embodiment examples, the inlet channel may be connected to the injection channel at a first location and the outlet channel may be connected to the injection channel at a second location, wherein the first and second locations are different from one another and the first location is located upstream of the second location (i.e. closer to the injection line of the refrigerant cycle from where the fluid is received).

In some preferred embodiments, the recess may comprise a bottom and two side walls and a sealed contact may be established between the insert and both side walls. The sealed contact separates the cooling chamber from the remainder of the volume within the recess which may form at least a part of the intermediate pressure cavity. Further, the insert may comprise at least one protruding element, which contacts the bottom of the recess. The at least one protruding element may define a height of the cooling chamber. By changing the dimensions of the at least one protruding element, the volume within the cooling chamber may be adjusted. Additionally or alternatively, the insert may comprise legs, which establish the sealed connection with the side walls. For example, the insert may have a cross-section which is essentially U-shaped. That means the insert has two legs, i.e. the upward facing legs of the U, which are connected to the walls of the recess. Opposite of the upward facing legs, the U-shaped insert may comprise at least one protruding element for defining the height of the cooling chamber. Alternatively, the U-shaped insert may be turned upside down so that the upwards facing legs of the U face towards the bottom of the recess. Thereby, the legs may define the height of the cooling chamber.

In some preferred embodiments, the insert may be made of the same material as the stationary scroll plate or a material, which has a similar thermal expansion characteristic as the material of the stationary scroll plate. For example, suitable materials may be steel or cast iron. However, also non-metal materials may be possible in case that their thermal expansion characteristic is similar to the material of the stationary scroll plate. Furthermore, in some embodiment examples, it may be possible to place a seal between the insert and walls of the recess.

In some preferred embodiments, an insulation layer may be added to the insert. The insulation layer may improve heat insulation between the cooling chamber and the intermediate pressure cavity. The insulating material may generally have a low thermal conductivity. Accordingly, non-metal material may preferably be used as insulating material. Examples of such materials may be synthetic polymers preferably composed of polyamides, such as nylon, polytetrafluoroethylene (PTFE), polyether ether ketone (PEEK) or ceramic materials. Alternatively, the insert may be coated with an insulating material. Preferably, the insulation layer is added to the insert at the side of the insert, which faces the intermediate pressure cavity. This would prevent heat transfer from the intermediate pressure cavity to the cooling chamber.

The abovementioned need may also be fulfilled by a scroll compressor comprising a stationary scroll plate according of the disclosure above. Such a scroll compressor further comprises a second scroll plate (i.e. an orbiting scroll plate), which preferably comprises additional features for improving temperature difference and reducing heat-induced stress and deformation. Moreover, the second scroll plate may comprise features for reducing thermal deformation, as will be described below.

Such a second scroll plate, which is an orbiting scroll plate, comprises a second base plate. The second base plate has a frontside and a backside, wherein the backside opposes the frontside. A second spiral wrap is formed on the frontside of the second base plate. The second spiral wrap is for being interleaved with a corresponding spiral wrap of the stationary scroll plate. Between the spiral wraps and the base plates of both scroll plates, the one or more compression chambers may be formed by orbiting motion of the orbiting scroll plate when the spiral wraps are interleaved and the compressor is operated.

The second base plate comprises one or more recesses, which are referred to as second recesses in order to distinguish from the recess of the first scroll plate, which is used for forming a cooling chamber, as mentioned above, and which is therefore referred to as first recess for the purpose of this embodiment example. The one or more second recesses may be located at the backside of the second base plate or the one or more second recesses may be located between the frontside and the backside of the second base plate. An insulating material is located in at least one of the one or more second recesses. The insulating material reduces the thermal stress and deformation induced by the temperature difference between the opposing frontside and backside of the second scroll plate.

Depending on the location of the insulating material, the insulating material may, for example, reduce heat transfer between the opposing sides of the second scroll plate and/or the insulating material may isolate one side of the second scroll plate from the temperature area that it surrounds. For example, in a preferred embodiment, at least one of the one or more second recesses may be located at a surface of the backside of the second base plate, which allows to isolate the second base plate from its surroundings. The insulating material located in the second recess may shield the corresponding side of the second scroll plate from its surroundings and may thereby reduce the influence that the surrounding temperature has on the side of the second scroll plate. In such a case, the temperature of both sides of the second scroll plate may be more similar, such that the temperature difference is reduced. In case of a low-pressure side and high-pressure side configuration, the surroundings may for example refer to the low-pressure side of the scroll compressor. Similarly, the surroundings may be the high-pressure side in case that the scroll compressor has a high-side configuration.

In a preferred embodiment, at least one of the one or more second recesses is located at a surface of the backside of the second base plate. Locating a second recess at the surface of the backside and placing the insulating material in said second recess at the surface allows to isolate the second base plate from its surrounding and thereby shielding the second base plate from either lower or higher temperatures and their effects on the temperature difference in the second base plate.

The backside of the second base plate may comprise a reception configured to receive a portion of a crankshaft of the compressor. When the crankshaft is operated, placement of a portion of the crankshaft in a reception allows to transfer motion from the crankshaft to the orbiting scroll plate. The reception may have the form of a protrusion, preferably in form of a ring, so that a pin of the crankshaft can be placed in the annular protrusion. However, the reception may also be an aperture in the second base plate. At least one second recess of the one or more recesses preferably may be located within the reception. Usually, the crankshaft is lubricated by a lubricant, which generally has a temperature, which is lower than the temperature of the fluid within the compression chambers; for example, the lubricant may have the suction side temperature. The pin of the crankshaft that is received by the reception of the orbiting scroll plate may also be lubricated in order to reduce wear between the pin and the reception. Consequently, the surface of the reception will experience the rather low temperature of the lubricant, e.g. the suction side temperature, while the opposing side of the second base plate at the location corresponding to the reception may experience a much higher temperature of the compressed fluid up to the discharge temperature. Therefore, providing a recess with insulating material in the reception is preferred because it efficiently reduces the heat transfer.

Additionally, or alternatively to placing a second recess and insulating material within the reception for the crankshaft, at least one recess of the one or more second recesses may be located outside of the reception, meaning that the second recess at least partially surrounds the reception. Thereby, the temperature difference of the sides of the second base plate may be reduced by isolating the backside of the orbiting scroll plate from its surroundings, e.g. a thrust surface, which may be used to support the orbiting scroll plate. Preferably, the at least one second recess, which is located outside of the reception, may form a closed ring around the reception, which reduces the temperature difference homogeneously around the reception. Further, at least two second recesses may form rings around the reception. These rings may be concentric and may improve management of the temperature difference over a larger portion of the orbiting scroll plate and lead to more homogenously reduced temperature difference.

In another preferred embodiment, at least one second recess of the one or more second recesses may be located beneath the surface of the backside of the second base plate. Thereby, the at least one second recess beneath the surface of the backside may be formed as a sealed chamber within the second base plate. The insulating material located in the recess beneath the surface of the backside may be a fluid. In particular, the fluid may be a gas, for example refrigerant vapor, or the fluid may be a liquid, for example a lubricant. However, also a solid non-metal material may be used as insulating material. Using a second recess beneath the surface of the second side improves management of temperature differences between the frontside and the backside of the orbiting scroll plate by reducing heat transfer from one side to the other side and thereby also reducing temperature induced stress and deformation.

In any of the abovementioned preferred embodiments, the insulating material may generally have a low thermal conductivity. Accordingly, non-metal material may preferably be used as insulating material. Examples of such materials may be synthetic polymers preferably composed of polyamides, such as nylon, polytetrafluoroethylene (PTFE), polyether ether ketone (PEEK) or ceramic materials.

The following description and the annexed drawings set forth in detail certain illustrative aspects of the apparatus and the method described above. These aspects are indicative, however, of but a few of the various ways in which the principles of various embodiments can be employed and the described embodiments are intended to include all such aspects and their equivalent.

DRAWINGS

In the drawings, like reference characters generally refer to the same parts throughout the different drawings. The drawings are not necessarily to scale, emphasis instead generally being placed upon illustrating the principles of the invention.

In the following description, various embodiments of the invention are described with reference to the following drawings, in which.

Figure 4A:
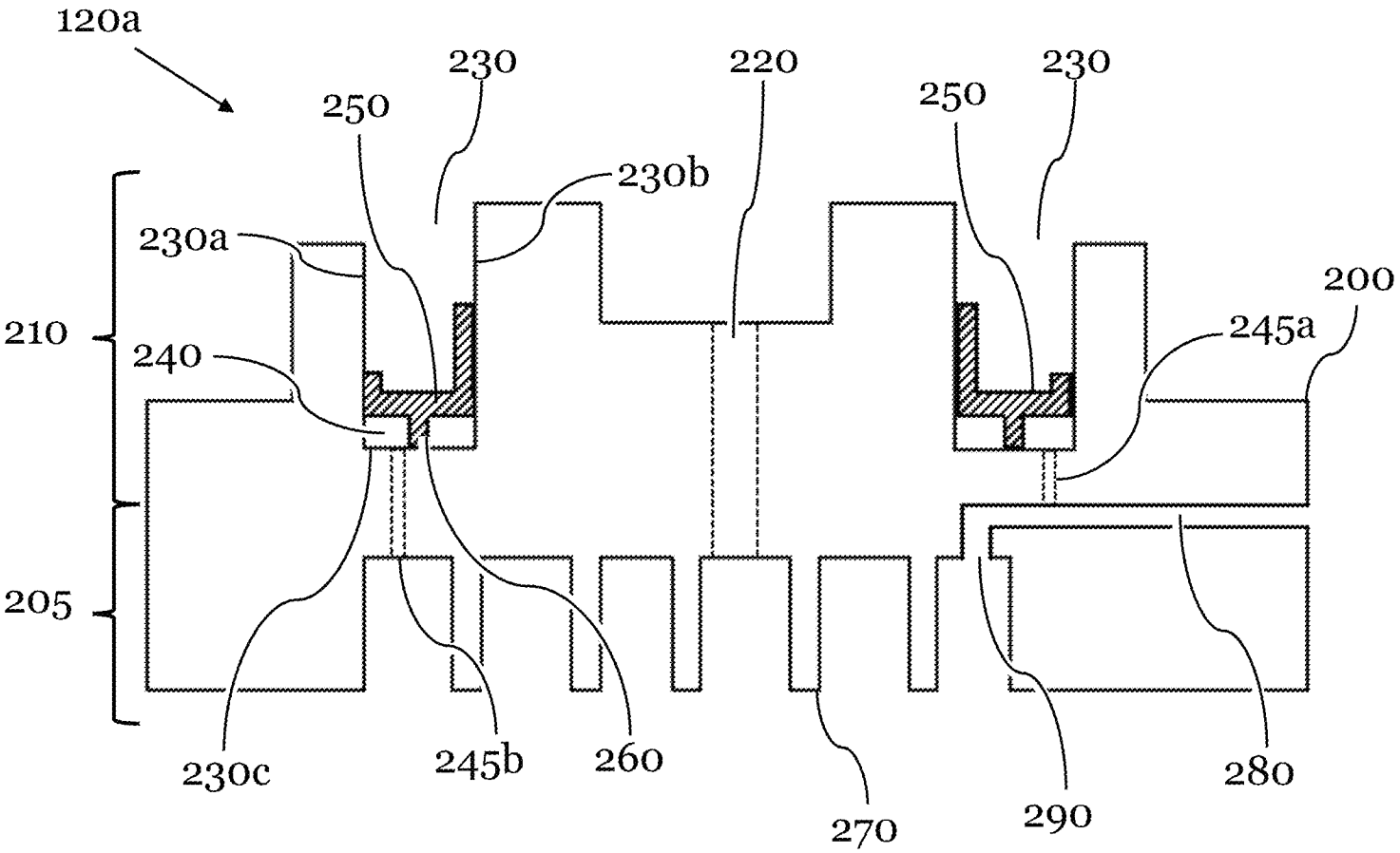
Figure 4B:
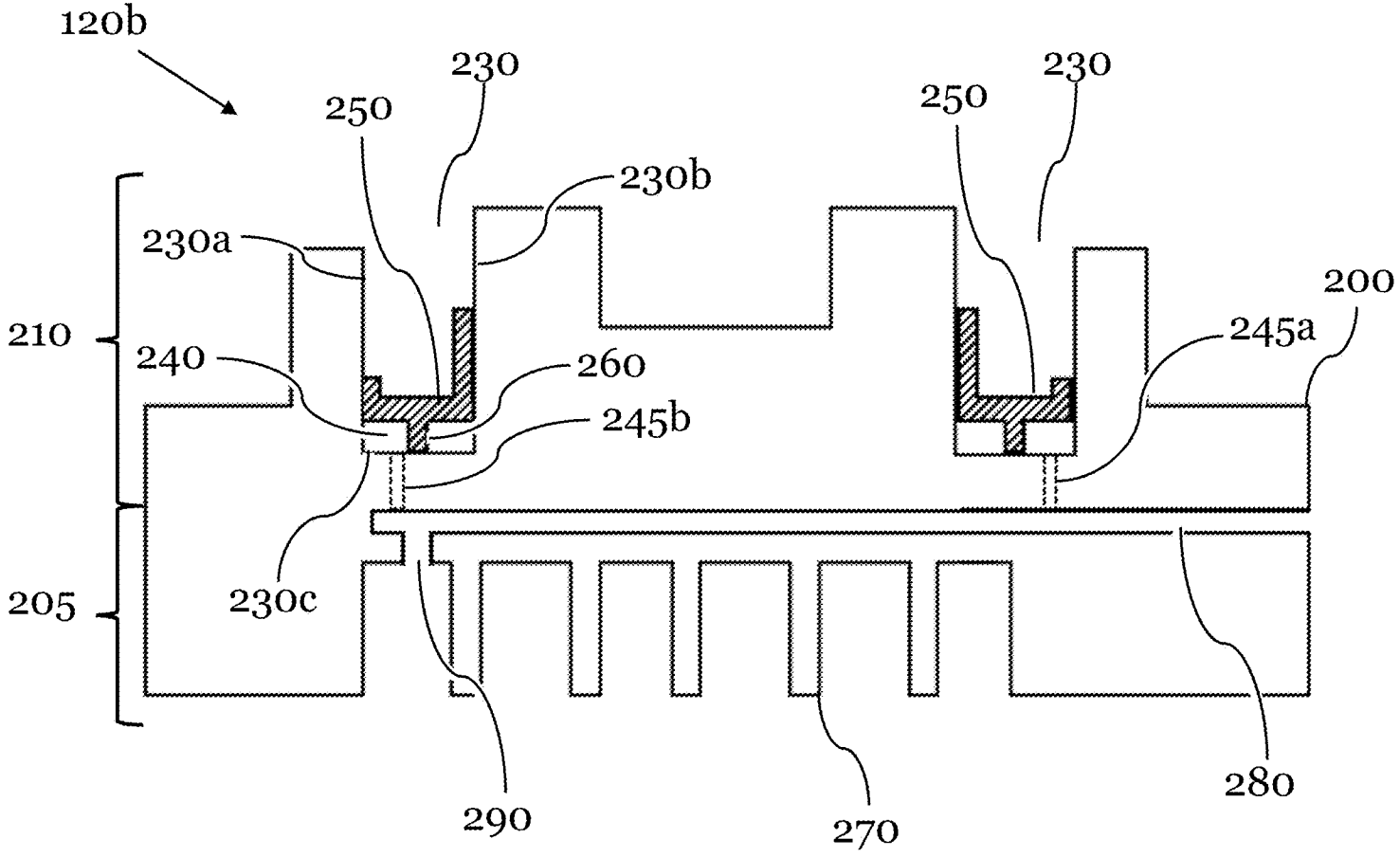

FIG. 4*a*, 4*b* show cross-sectional views of embodiment examples of stationary scroll plates according to the current invention.

Figure 5:
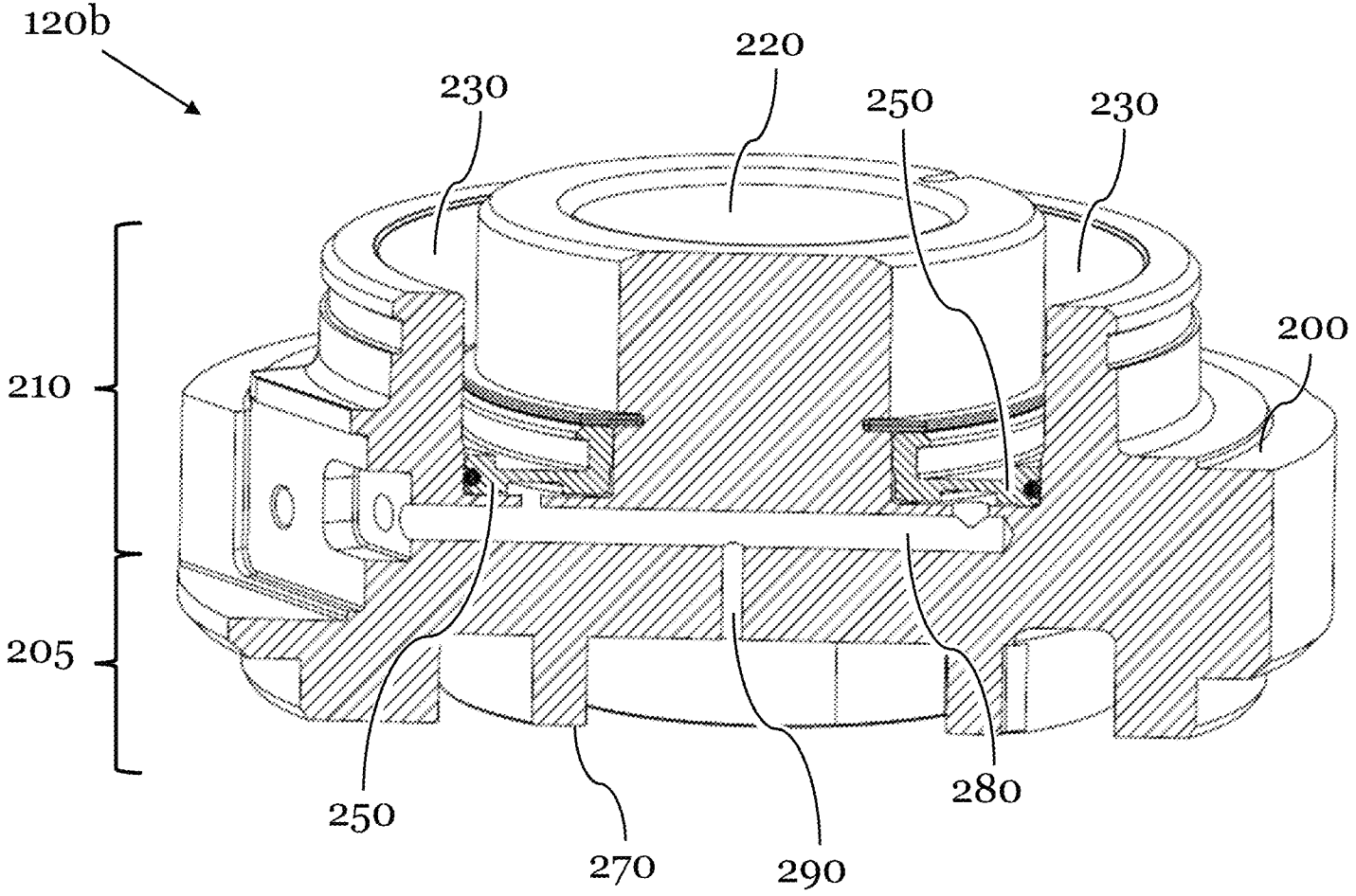

FIG. 5 shows a partially perspective view of an embodiment example of a stationary scroll plate according to the current invention.

Figure 6A:
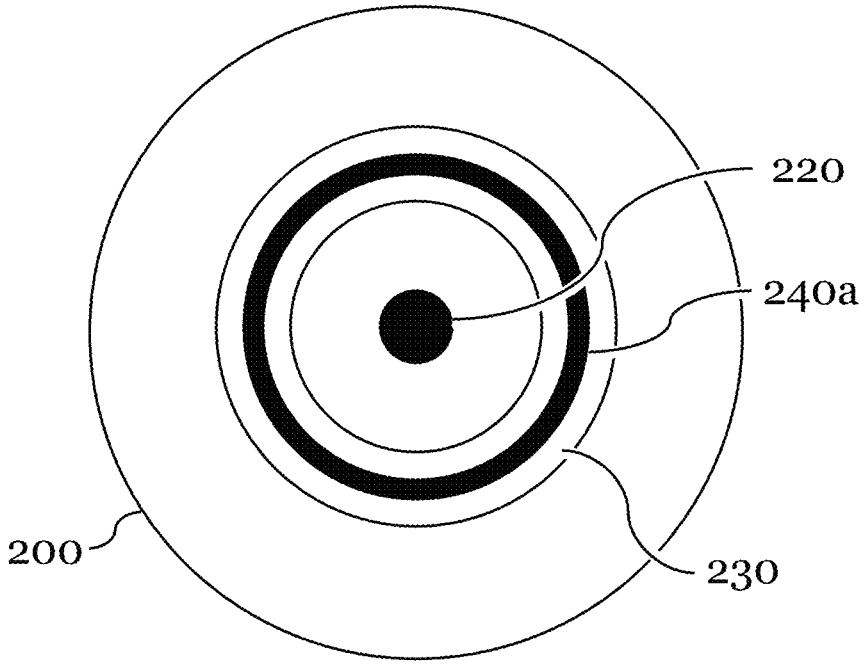
Figure 6B:
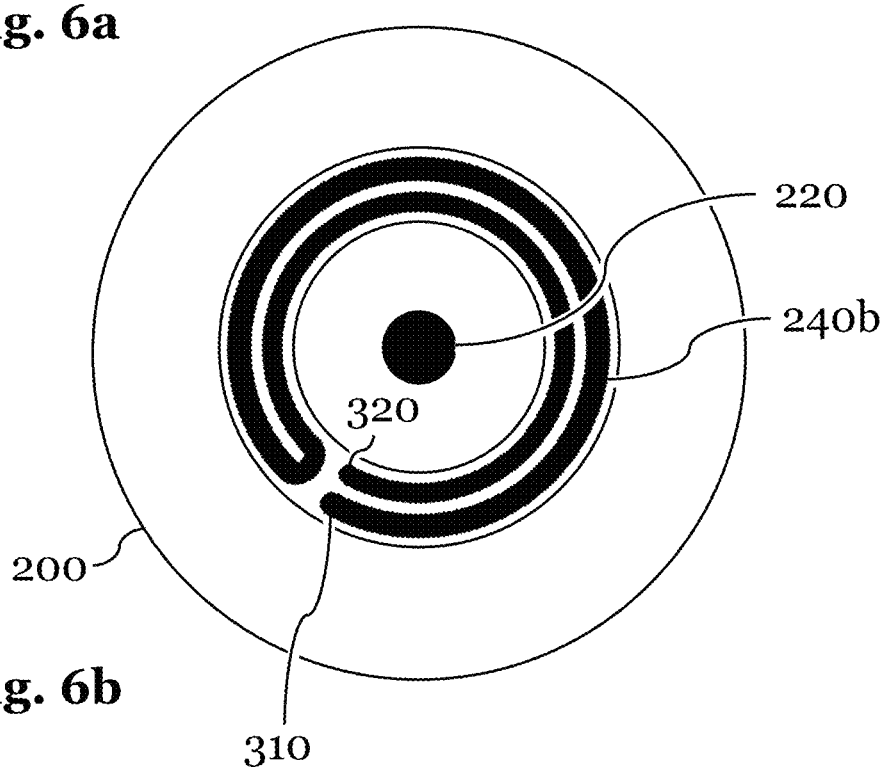

FIGS. 6*a*, 6*b* show two exemplary types of cooling chambers formed within the recess by the insert.

Figure 7A:
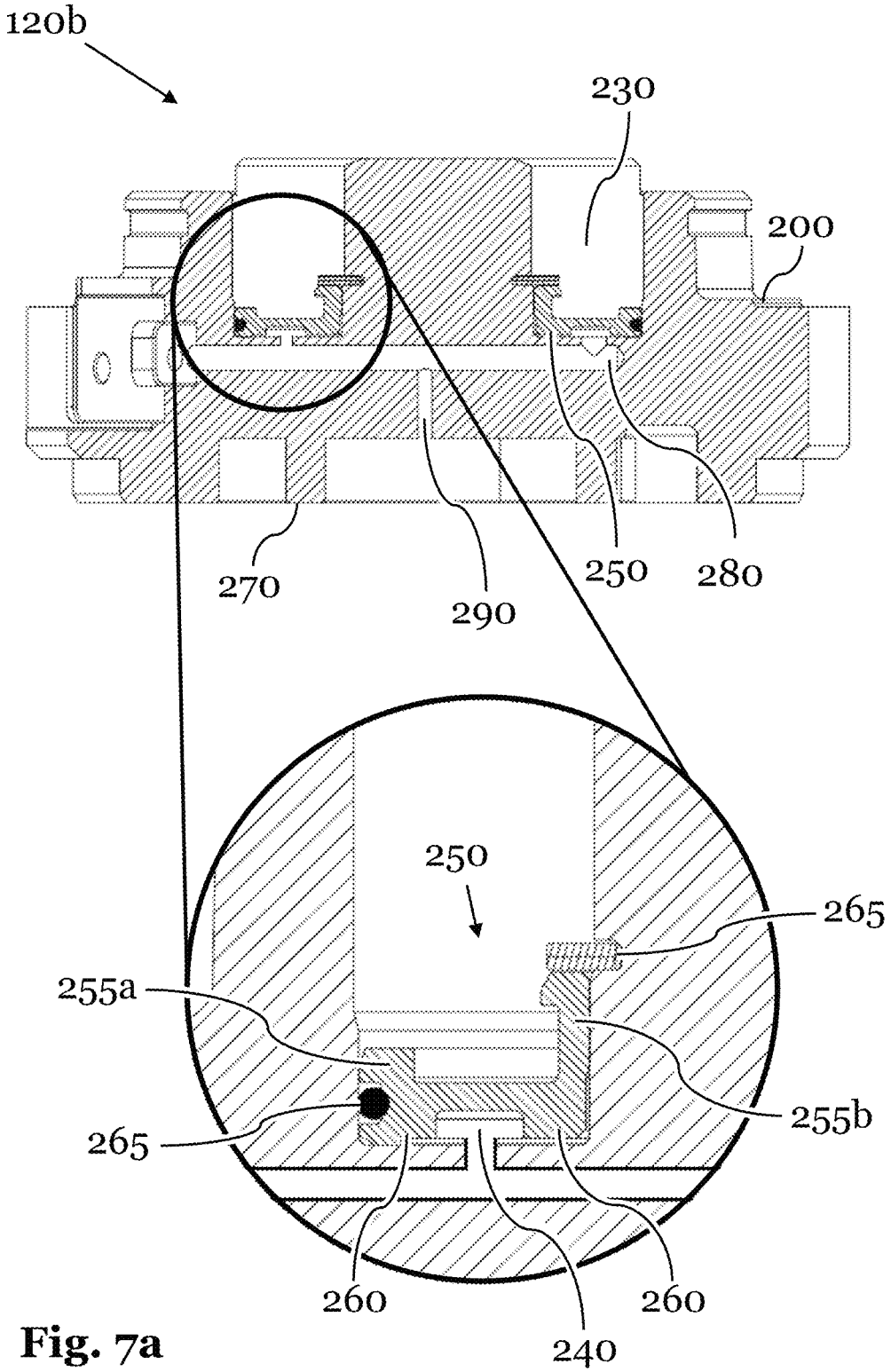
Figure 7B:
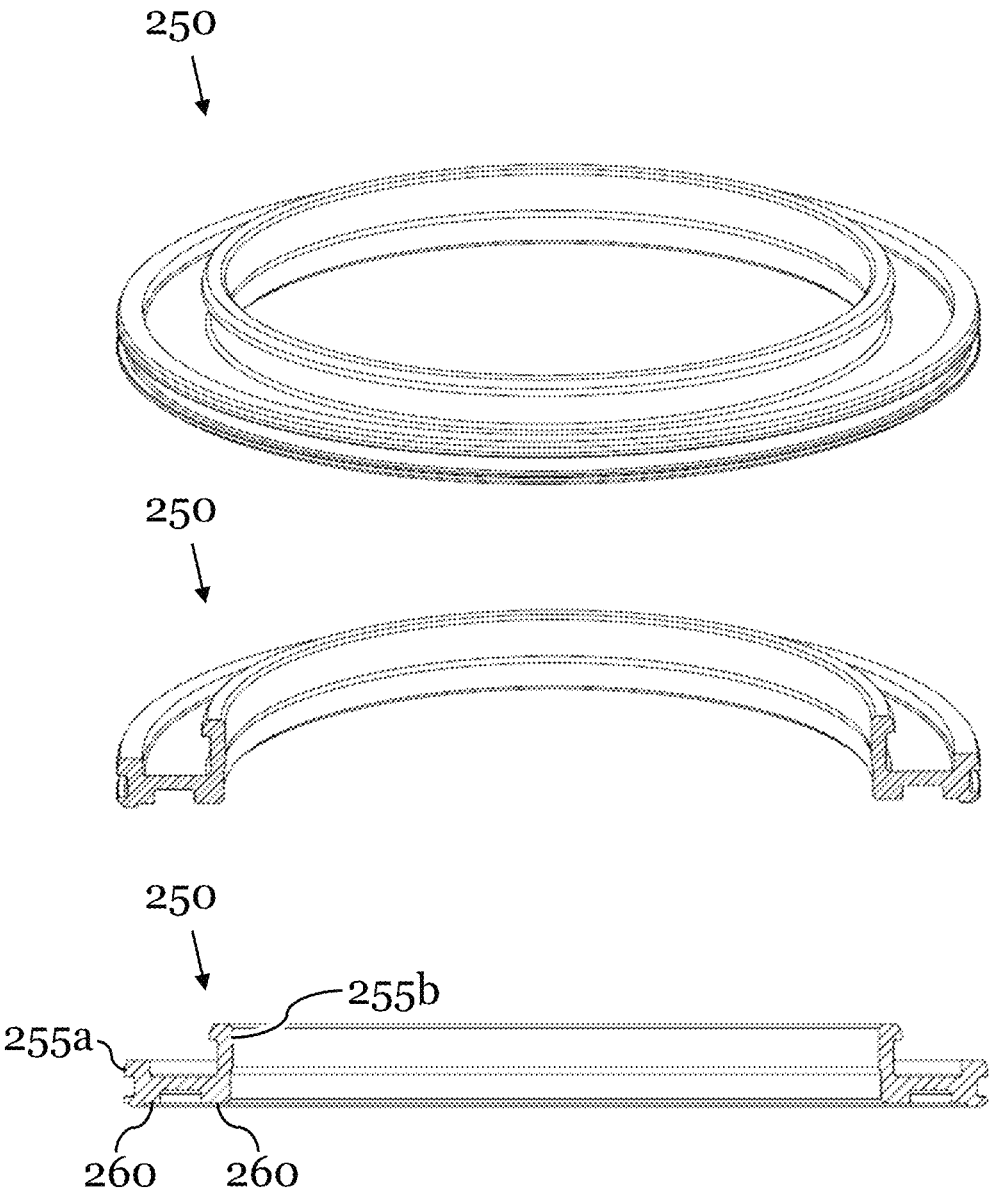

FIGS. 7*a*, 7*b* show (a) a cross-sectional detail view of preferred embodiment of an insert placed within a recess of a stationary scroll plate and (b) a perspective view of the preferred embodiment of the insert.

Figure 8A:
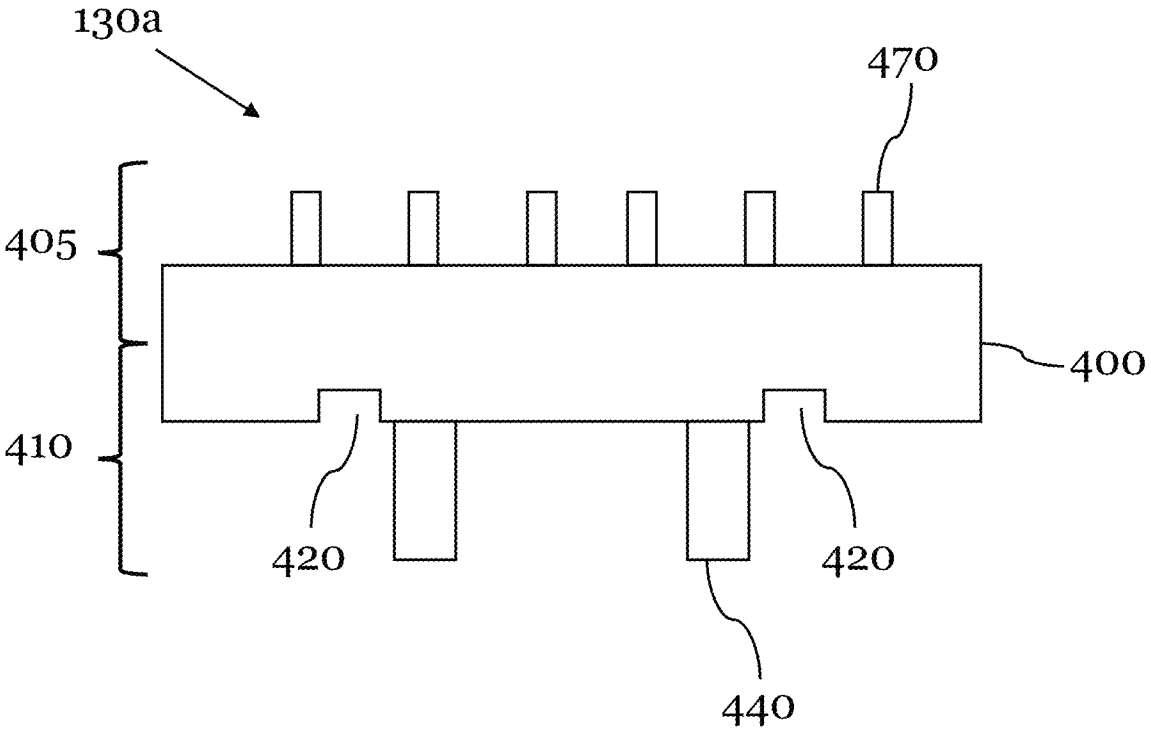
Figure 8B:
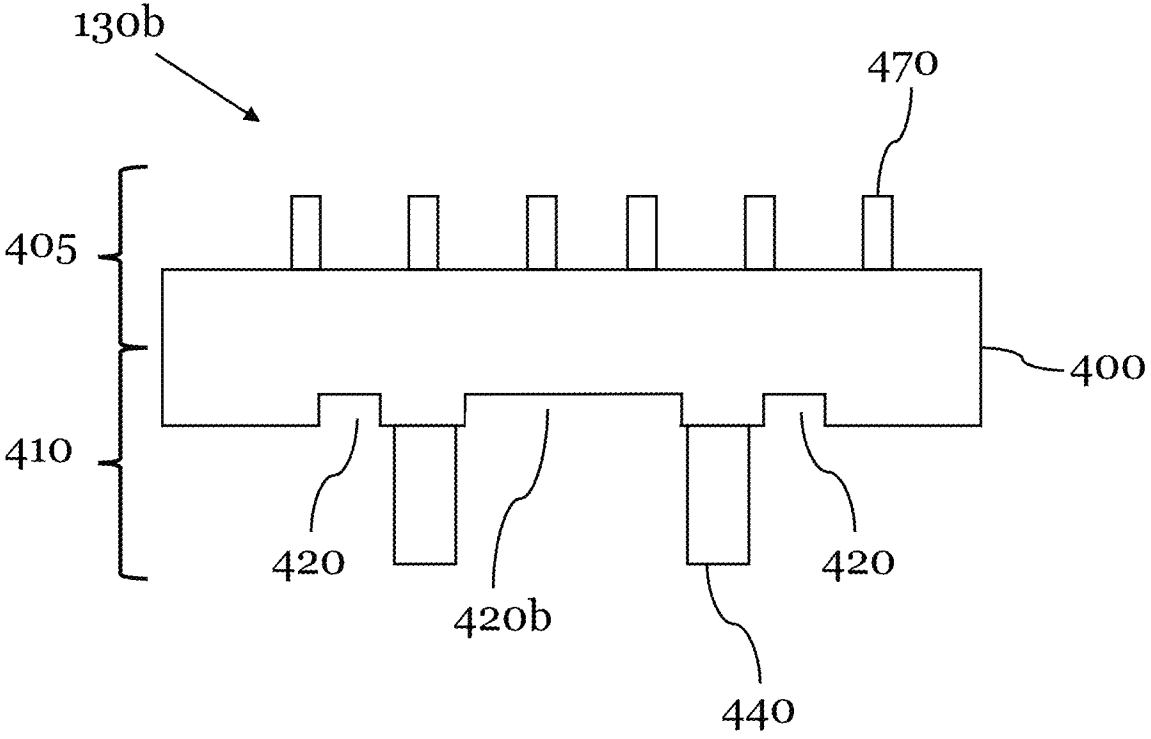
Figure 8C:
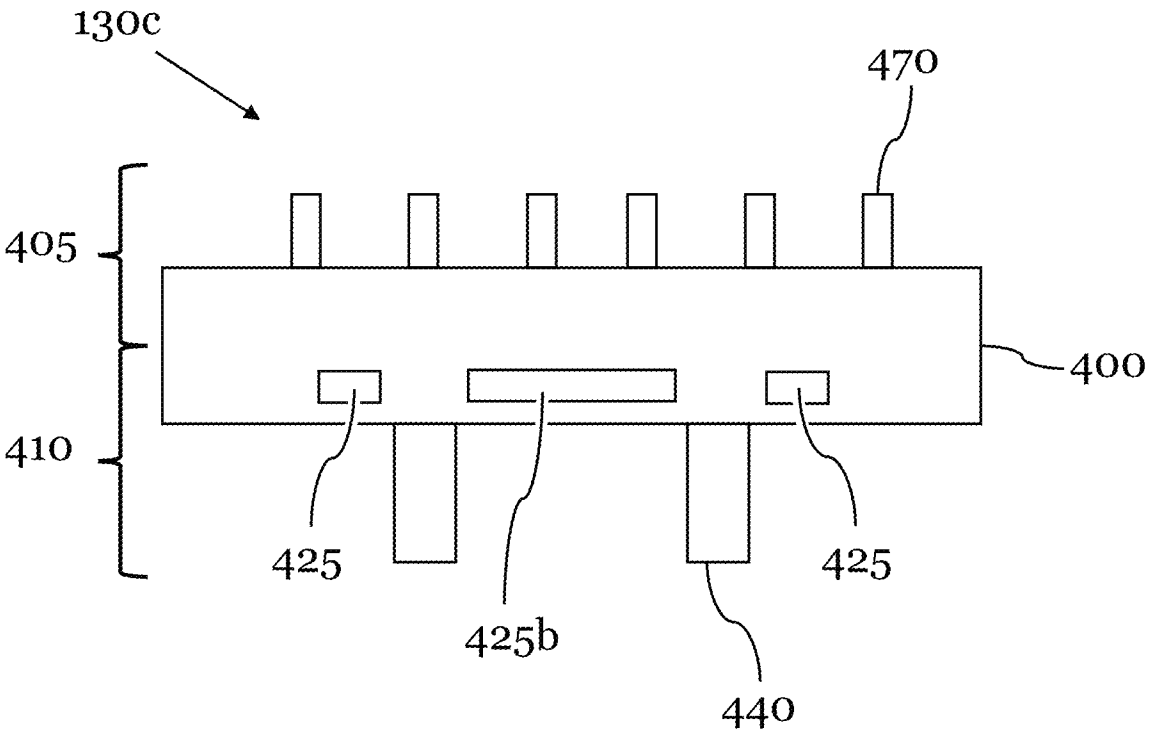

FIGS. 8*a*-8*c* show cross-sectional views of some embodiments of an orbiting scroll plate that may be used in conjunction with the stationary scroll plate according to the current invention.

Figure 9A:
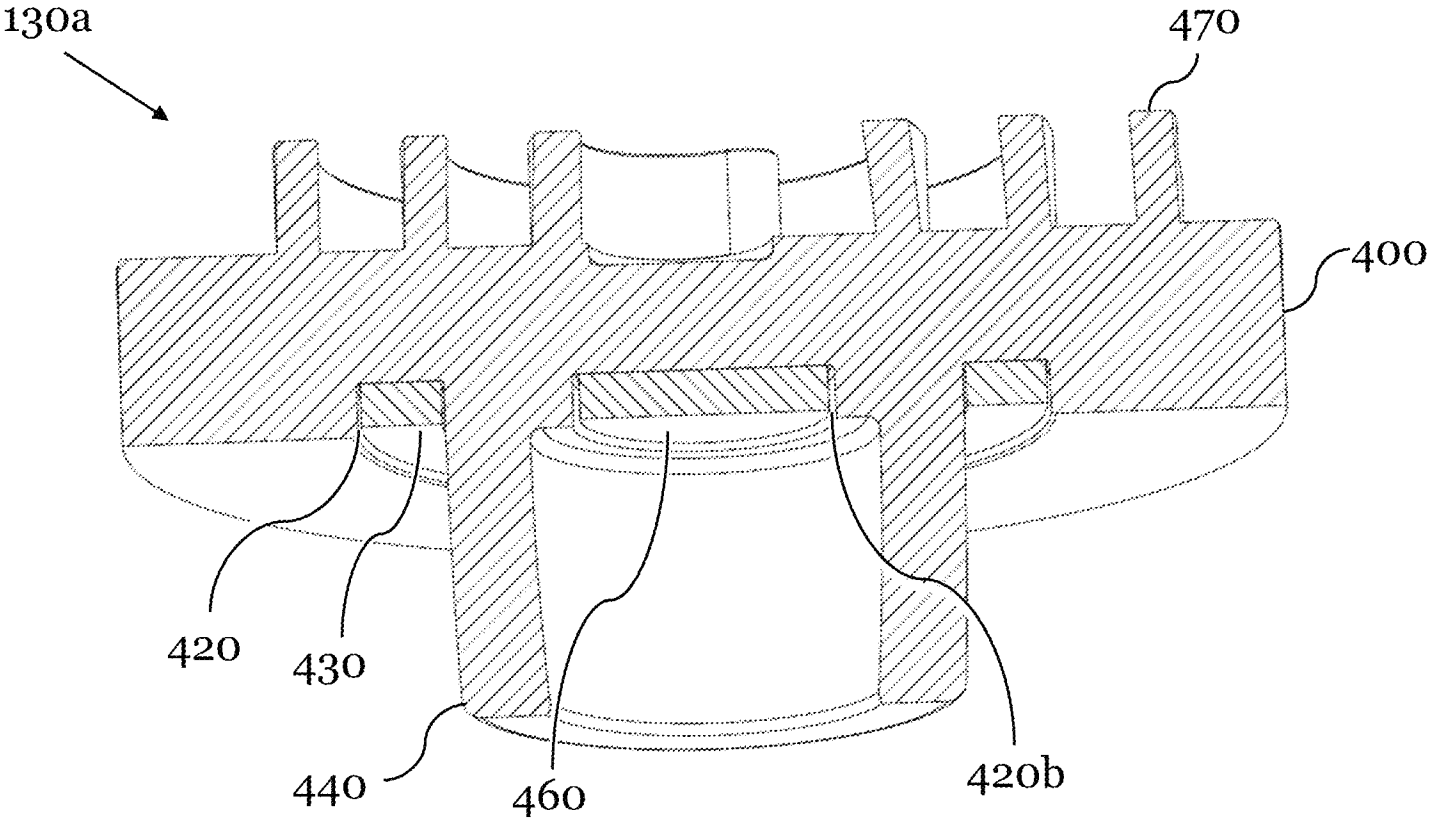
Figure 9B:
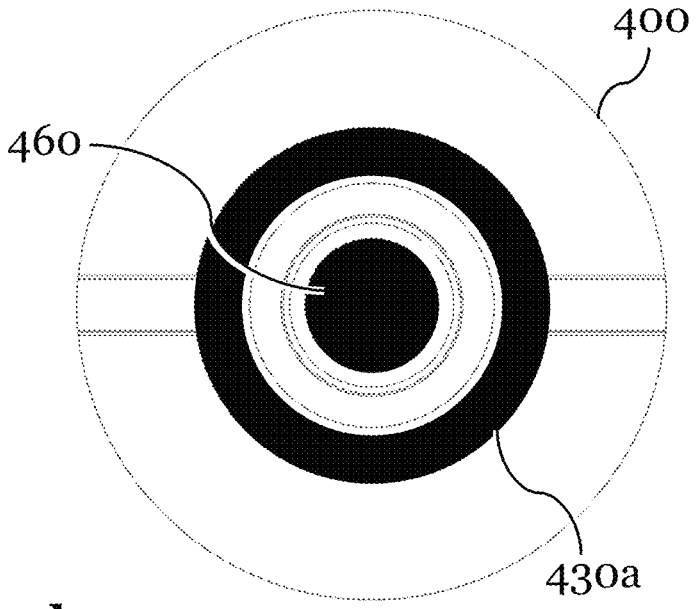
Figure 9C:
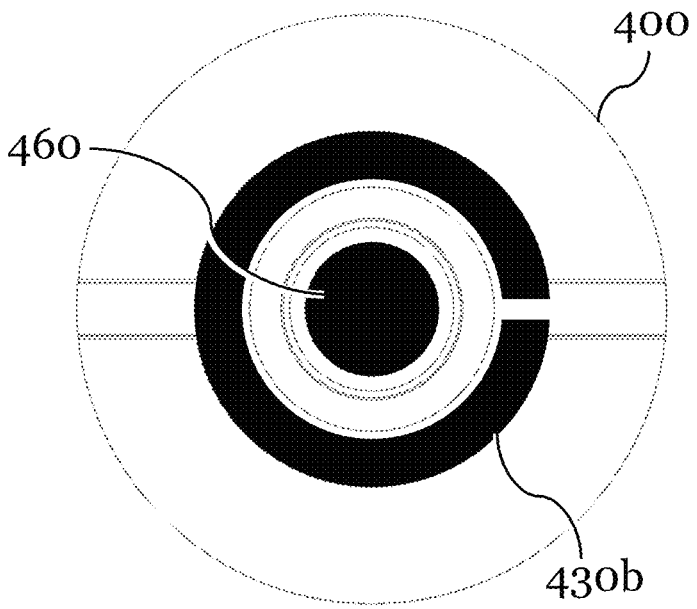

FIGS. 9*a*-9*c* show an embodiment example of an orbiting scroll plate of FIG. 8*b*, wherein (a) is a perspective view of an embodiment example of the orbiting scroll plate cut in half and (b), (c) are top views of the backside of the orbiting scroll plate with different designs of insulating material.

Figure 10A:
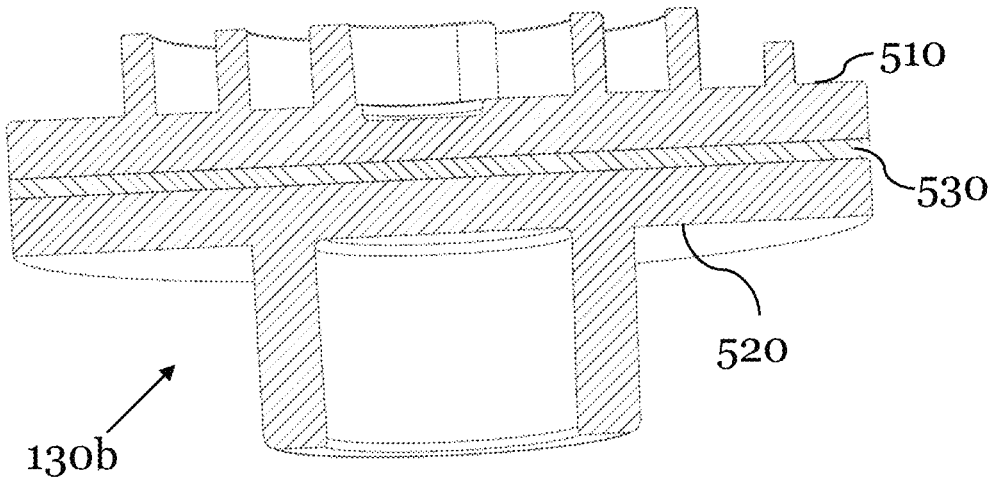
Figure 10B:
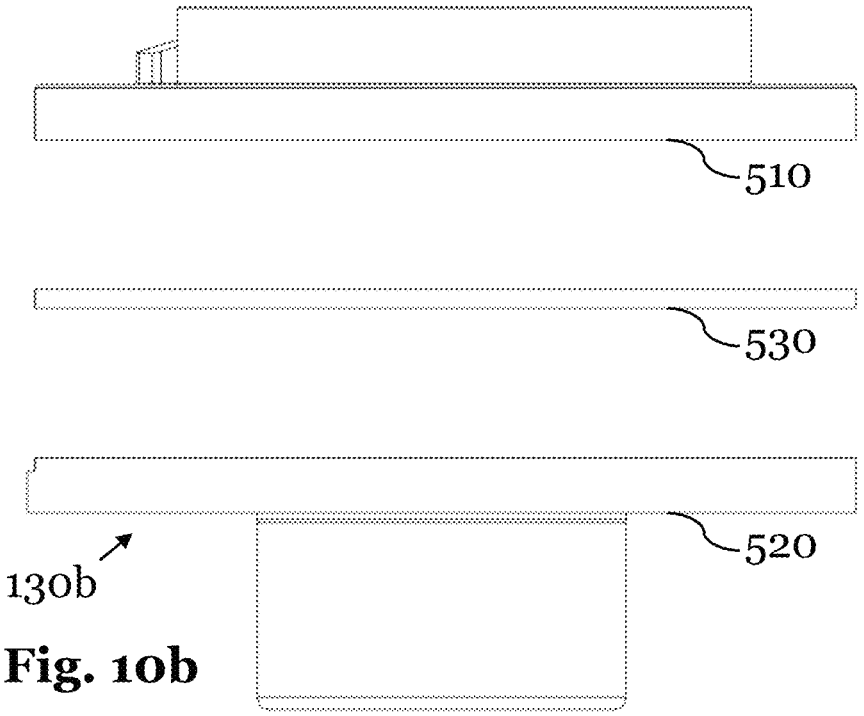

FIGS. 10*a*, 10*b* show another embodiment example of an orbiting scroll plate that may be used in conjunction with the stationary scroll plate according to the current invention, wherein the base plate of the orbiting scroll plate consists of two separate parts, wherein the first part comprises the first side and the second part comprises the second side and wherein the insulating material is placed between the first part and the second part. (a) is a perspective view said embodiment example of the orbiting scroll plate cut in half and (b) is an exploded view of the orbiting scroll plate according to said embodiment.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1:
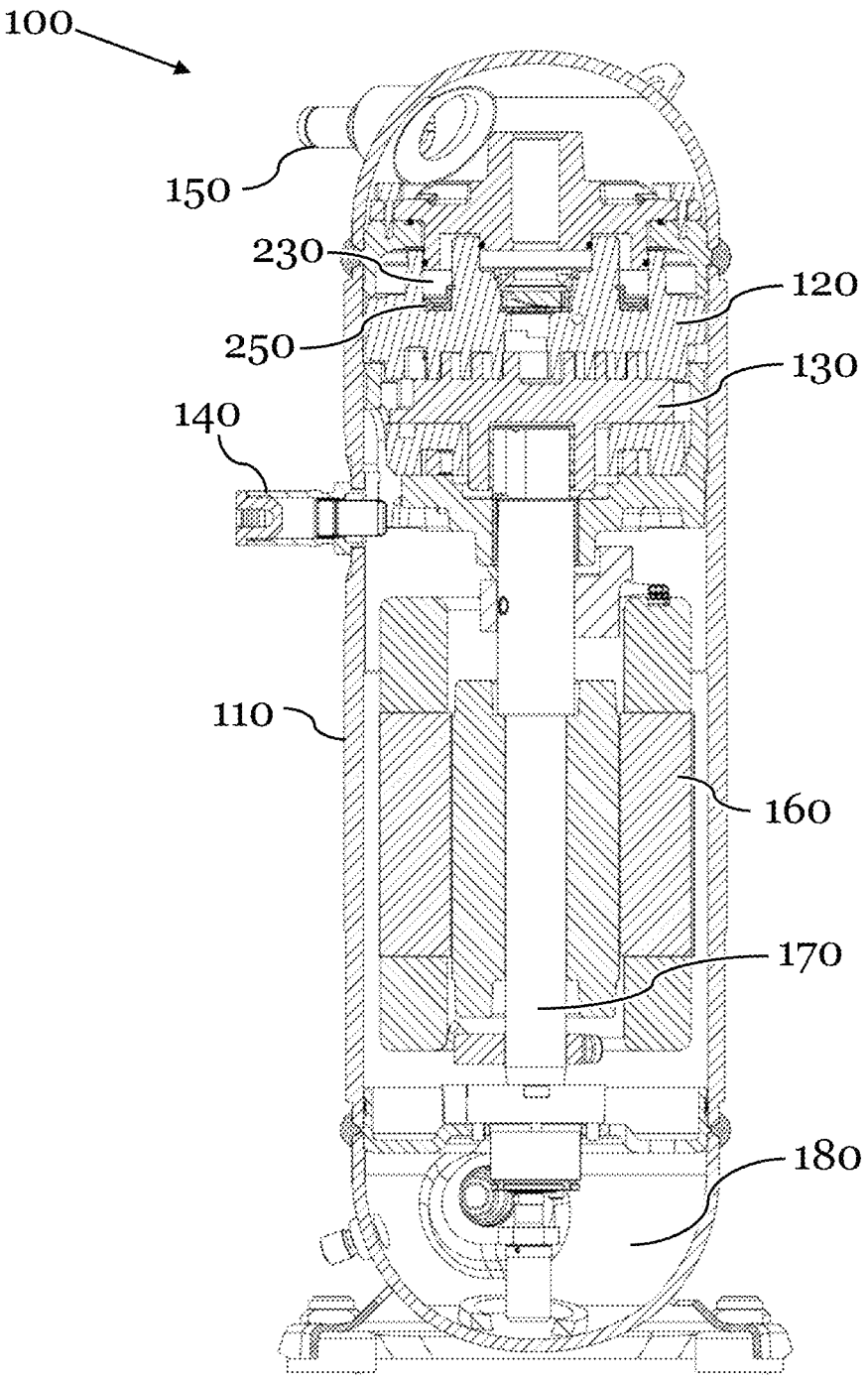
FIG. 1 shows a cross-sectional view of an embodiment of a scroll compressor in which the current invention can be used.

FIG. 1 shows a cross-sectional view of an embodiment of a scroll compressor in which the current invention can be used. At 100, a scroll compressor is depicted. The scroll compressor comprises a case 110, a suction port 140, a discharge port 150, a stationary scroll plate 120 and an orbiting scroll plate 130. Further, the scroll compressor 100 comprises a motor 160, which is connected to a crankshaft 170 and the crankshaft 170 is connected to the orbiting scroll plate 130. Thereby, the motor drives the crankshaft 170 and causes a rotary motion of the crankshaft 170. Because the crankshaft is connected to the orbiting scroll plate 130, the rotary motion is transferred to an orbiting motion of the orbiting scroll plate 130. Further, the scroll compressor 100 comprises a lubricant supply 180, which may provide lubricant to the crankshaft 170, the orbiting scroll plate 130 and the stationary scroll plate 120.

The scroll compressor 100 has a low-pressure side and high-pressure side configuration. In this configuration, the low-pressure side comprises a lubricant supply 180, the motor 160, the crankshaft 170 and the suction port 140, whereas the high-pressure side comprises the discharge port 150. The stationary scroll plate 120 and the orbiting scroll plate 130 form a transition area from the low-pressure side to the high-pressure side.

Figure 2:
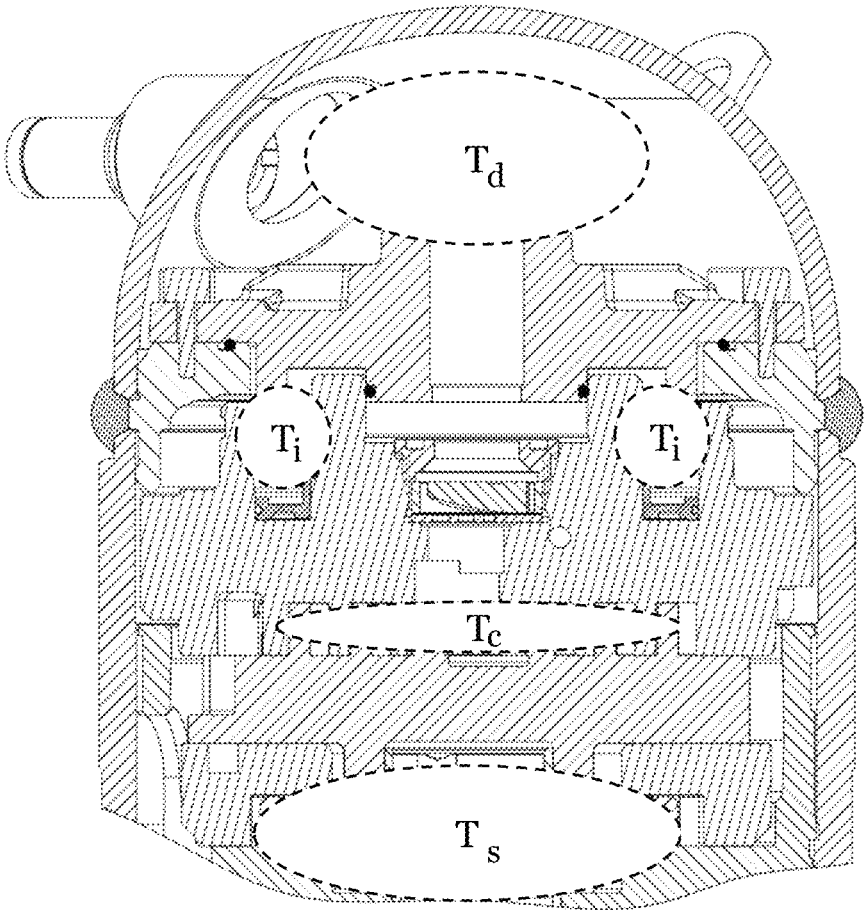
FIG. 2 shows a highlighted portion of the upper portion of the scroll compressor of FIG. 1 and illustrates the temperature areas within the scroll compressor.

FIG. 2 shows a highlighted area of the upper portion of the scroll compressor of FIG. 1 and illustrates the temperature areas within the scroll compressor.

At the low-pressure side, the fluid is received at the suction port. Since the fluid received at the suction port has a rather low pressure and temperature, the temperature at the low-pressure side is also rather low. In FIG. 2, the temperature of the low-pressure side is denoted as suction side temperature $T_S$. Although the low-pressure side is characterized by a single temperature $T_S$ in FIG. 2, the person skilled in the art will appreciate that the temperature distribution at the low-pressure side is not necessarily homogenous.

Similarly, at the high-pressure side, the compressed fluid has the highest temperature, which is denoted discharge temperature $T_d$. Again, the person skilled in the art will appreciate that deviations from the discharge temperature may occur and that the temperature distribution at the high-pressure side is not necessarily homogenous.

Further, the temperature in the compression chambers formed between the orbiting scroll plate and the stationary plate is higher than or equal to the suction side temperature $T_S$ and lower than or equal to the discharge temperature $T_d$. During the compression procedure, the temperature in the compression chamber is increased from the suction side temperature $T_S$ to the discharge temperature $T_d$. The temperature in the compression chambers is denoted $T_c$. Again, the person skilled in the art will appreciate that the temperature distribution in the compression chambers is not homogenous as has been described before.

The compressor configuration depicted in FIG. 2 further has a so-called intermediate pressure cavity, which is located between the stationary scroll plate and a portion of the supporting frame to which the stationary scroll plate is attached. The intermediate pressure cavity is connected to the compression chambers for at least a portion of time via a so-called bleed hole, which relates the pressure inside the compression chambers to the pressure inside the intermediate pressure cavity. Further, the intermediate pressure cavity is used for pressing the stationary scroll plate against the orbiting scroll plate, thereby improving the sealing between the scroll plates. As is depicted in FIG. 2, the temperature of the fluid within the intermediate pressure cavity denoted is $T_i$, which is a temperature higher than the suction side temperature $T_S$ but lower than the discharge temperature $T_d$.

As the person skilled in the art will appreciate, the temperature areas depicted in FIG. 2 are simplifications and used for illustrative purposes only. As mentioned earlier, the temperature areas do not need to be homogeneous. Instead, they may represent temperature intervals. This is particularly important for the compression chamber temperature $T_c$, which ranges from values similar to the suction side temperature $T_S$ at locations on the left and right hand side of FIG. 2 to values similar to the discharge temperature $T_d$ at the center of the interleaved scroll plates.

The frontside of the stationary scroll plate faces the compression chambers and has a temperature similar to temperature $T_c$. The backside of the stationary scroll plate is in contact to the intermediate pressure cavity having temperature $T_i$ and in close contact to the high-pressure side having temperature $T_d$. Therefore, the temperature at the backside of the stationary scroll plate is higher than the temperature $T_c$ of the frontside and may be close to the discharge temperature $T_d$.

Similarly, the frontside of the orbiting scroll plate faces the compression chambers and also has a temperature similar to temperature $T_c$. The backside of the orbiting scroll plate is in contact to the low-pressure side having the suction side temperature $T_i$. Therefore, the temperature at the backside of the orbiting scroll plate is similar to the suction side temperature $T_S$.

Figure 3:
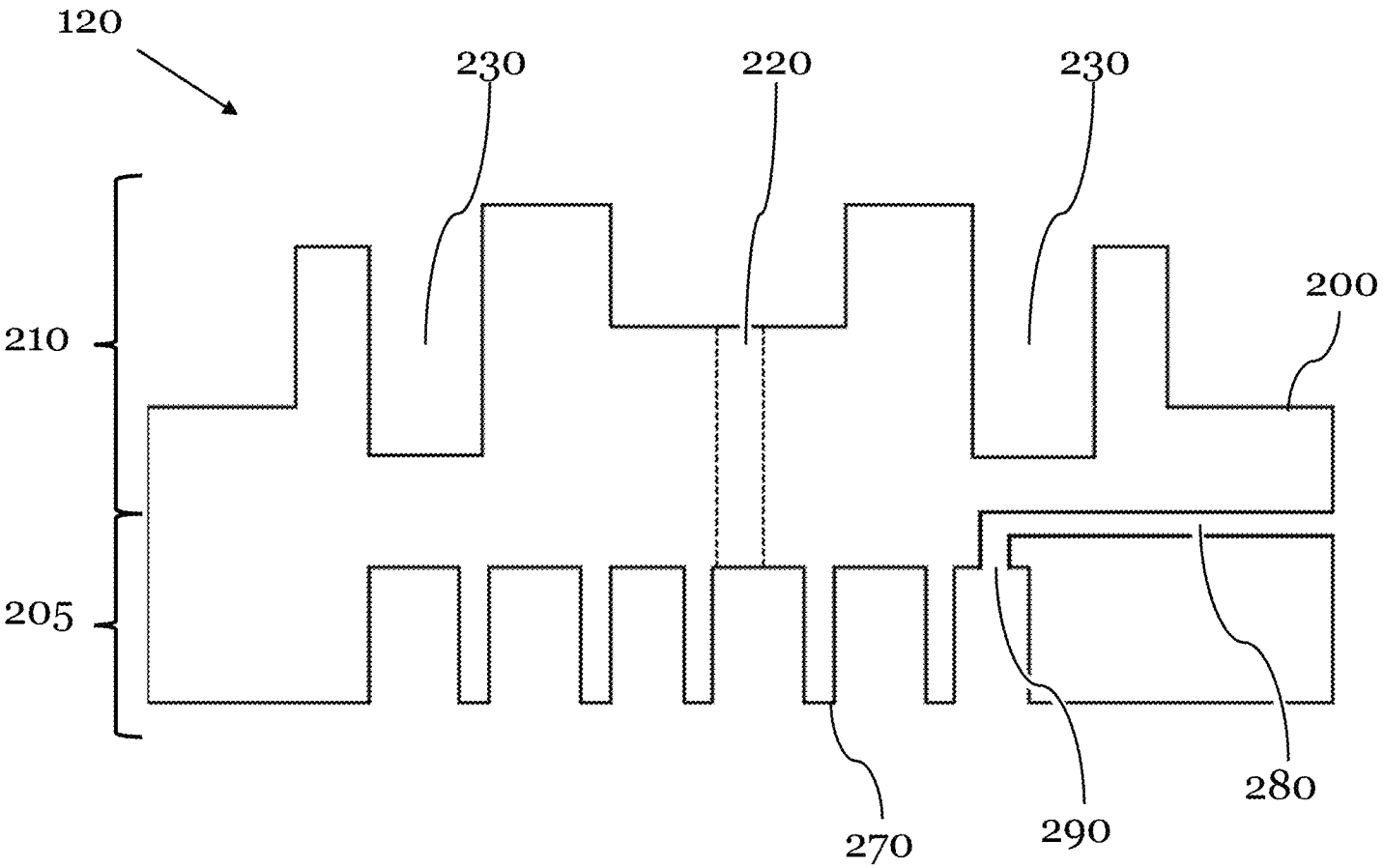
FIG. 3 shows a cross-sectional view of an embodiment example of a stationary scroll plate with an injection channel.

FIG. 3 shows a cross-sectional view of a stationary scroll plate 120. The stationary scroll plate comprises a base plate 200 having a first side 205 and a second side 210.

The first side 205 of the base plate 200 comprises a spiral wrap 270 configured to form one or more compression chambers when being interleaved with a corresponding spiral wrap of an orbiting scroll plate.

An aperture 220 extends through the base plate and provides a passage from a location within the spiral wrap on the first side to the second side. The passage is indicated in dashed lines and may be used for ejecting compressed fluid from the compression chambers.

The second side 210 comprises a recess 230. In this example of a stationary scroll plate, the recess 230 is formed as an annular ring around the aperture 220.

The base plate 220 further comprises an injection channel 280, which provides an injection path for injection of fluid into the compression chamber, which is formed between the corresponding spiral wraps 270. In order to provide for an input into the compression chamber, the first side comprises an opening, the so-called injection hole 290.

FIGS. 4*a* and 4*b* show cross-sectional views of embodiment examples of stationary scroll plates 120*a*, 120*b* according to the current invention. Compared to the stationary scroll plate 120, the stationary scroll plate 120*a* depicted in FIG. 4*a* comprises an insert 250 placed within the recess 230 on the second side 210 of the base plate 200. The insert 250 forms a cooling chamber 240 within the recess 230, which represents a volume within the recess 230, which is separated from the remaining volume.

In order to provide a sealed separation from the remaining volume within the recess 230, side portions of the insert 250 are connected to side walls 230*a*, 230*b* of the recess 230. The side portions may be formed by legs 255*a*, 255*b* as will be illustrated in more detail with respect to FIG. 7*a*.

Another portion of the insert 250, which may be formed by a protrusion 260, keeps the insert 250 in a particular distance from the bottom 230*c* of the recess 230. As is illustrated in FIG. 4, the protrusion 260 may define the height of the cooling chamber 240.

In the embodiment examples depicted in FIGS. 4*a* and 4*b*, the recess 230 and the insert 250 have annular shapes, which will be illustrated in more detail with respect to FIG. 5.

The fluid that may for example be received from an injection line of a refrigeration cycle flows through the injection channel 280 within the base plate 200. Through an inlet channel 245*a*, a portion of the fluid flows into the cooling chamber 240. After passing through the cooling chamber 240, the fluid flows through the outlet channel 245*b* into the compression chamber formed between the interleaved spiral wraps 270.

FIG. 4*b* represents another embodiment example of a stationary scroll plate 120*b* according to the current invention. For illustrative purposes, the aperture 220, which forms the channel for ejecting compressed fluid from the compression chamber, is not shown in FIG. 4*b*. Compared to the stationary scroll plate 120*a*, stationary scroll plate 120*b* has another fluid flow between the cooling chamber 240 and the injection channel 280. In the stationary scroll plate 120*b*, fluid is again received in the injection channel 280. From there, a portion of the fluid flows through the inlet channel 245*a* into the cooling chamber 240. After passing through the cooling chamber 240, the fluid flows through the outlet channel 245*b* back to the injection channel 280 and then through the injection hole 290 into the compression chamber. Compared to the stationary scroll plate 120*a*, stationary scroll plate 120*b* reduces the number of openings within the inside of the spiral wrap. Accordingly, the fluid is provided to the compression chambers at less locations, which may make the compression process more uniformly.

The person skilled in the art will appreciate that there are several other configurations possible. Further, there may be more than one inlet channel 245*a* and/or more than one outlet channel 245*b*. In case of two or more outlet channels 245*b*, it would therefore also be possible to combine the principles depicted in FIGS. 4*a* and 4*b* by providing a first outlet channel 245*b* that directly lead to the inside of the spiral wrap 270, whereas a second outlet channel 245*b* leads back to the injection channel 280.

Further, the person skilled in the art will appreciate that there often are two branches of compression chambers are formed between the stationary scroll plate and the orbiting scroll plate. Most commonly, the two branches are formed on either side of the spiral wrap of the orbiting scroll plate when it is orbiting relatively to the spiral wrap of the stationary scroll plate. Preferably, the branches form symmetric compression chambers. For two branches of compression chambers, injection holes 290 and/or outlet channels 245*b* are provided for each respective one of the two branches.

FIG. 5 shows a partially perspective view of an embodiment example of a stationary scroll plate 120*b* according to the current invention. The embodiment example of the stationary scroll plate depicted in FIG. 5 may be similar or identical to the stationary scroll plate 120*b* depicted in in FIG. 4*b*. In the view illustrated in FIG. 5, a portion of the stationary scroll plate 120*b* is cut away in order to illustrate more details of the interior features.

As can be seen, the recess 230 is an annular recess and extends around the aperture 220. The annular recess 230 and the aperture 220 may be concentric as is depicted in FIG. 5, but this is not necessarily the case.

The insert 250 placed in the annular recess 230 may also be annular as is illustrated in FIG. 5. In order to achieve a symmetrical distribution of the cooling effect, it is preferred that the insert 250 extends through the entire recess area. However, it is also possible that the insert 250 is only partially annular, so that it extends only through a portion of the recess 230.

FIGS. 6*a* and 6*b* show two exemplary types of cooling chambers formed within the recess by the insert. FIGS. 6*a*, 6*b* illustrate a top view of the arrangement of the cooling chamber 240 formed by the insert 250 in the recess 230.

In the first example, which is depicted in FIG. 6*a*, the recess 230 has an annular shape and extends around the aperture 220. The cooling chamber 240*a* formed by the insert 250 within the recess also has an annular shape. The openings of the cooling chamber 240*a* to inlet and outlet channels, respectively, are not illustrated in the figure but may preferably be located at opposing sides of the annular ring, e.g. at locations corresponding to 12 o'clock and 6 o'clock in the FIG. 6 or any other opposing locations. In this way, the fluid received from the injection channel 280 via the first opening may distribute to two paths within the cooling chamber 240*a* and be guided to the second opening.

In the second example, which is depicted in FIG. 6*b*, the recess 230 again has an annular shape and extends around the aperture 220. The cooling chamber 240*b* formed by the insert 250 within the recess comprises a path, which is essentially formed by two concentric rings, which are connected. This way, the fluid can enter cooling chamber 240*b* via the inlet channel that ends in a first opening 310 and is guided through the cooling chamber 240*b* for almost an entire outer ring of the recess 230, experiences a turn and is then guided within the inner ring towards the second opening 320 from where it is provided outlet channel.

The person skilled in the art will appreciate that various kinds of other cooling chamber arrangements are also possible and achieve the same or similar effects as the examples, which are explicitly shown in the figures. In particular any arrangement, in which the cooling chamber only covers a portion of the annular recess 230 is also encompassed by the scope of current invention even though such examples are not explicitly shown.

Further, the person skilled in the art will appreciate that multiple first openings, which connect the cooling chamber with the inlet channel within the base plate, and multiple second openings, which connect the cooling chamber with the outlet channel are also possible, even though this is not explicitly shown. Thereby, curved cooling chambers and several branches can be designed.

The at least one protrusion of the insert may be used to define the course of the cooling chamber in order to achieve the aforementioned designs.

FIGS. 7*a*, 7*b* show (a) a cross-sectional detail view of preferred embodiment of an insert placed within a recess of a stationary scroll plate and (b) a perspective view of the preferred embodiment of the insert.

The insert 250 depicted in FIG. 7*a* essentially has a U-shaped cross-section with two legs 255*a* and 255*b*. These legs 255*a*, 255*b* can be used to connect the insert 250 to the side walls 230*a*, 230*b* of the recess 230. The connection may preferably be a sealed connection, so that the cooling chamber 240 is sealed from the intermediate pressure cavity formed in the remaining part of the recess 230. The sealing may for example be achieved by interference fit or usage of a sealing element.

Further, the insert 250 comprises at least one protrusion 260. The at least one protrusion 260 lies on the bottom 230*c* of the recess. Hence, the length of the protrusion 260 defines the height of the cooling chamber 240. In the embodiment example depicted in FIG. 7*a*, the insert 250 comprises two protrusions 260, which are located at the edges of the insert 250, or in other words at locations opposing the legs 255*a*, 255*b*. The two protrusions 260 allow the forming of the cooling chamber 240 between them and the bottom of the recess. Alternatively but not shown, the insert may comprise a single protrusion located centrally (similar to what is shown in FIGS. 4*a*, 4*b*), so that the cooling chamber is formed on either sides of the protrusion.

In another example, which is not depicted in the figures, the legs 255*a*, 255*b* of the insert 250 may face toward the bottom 230*c* of the recess 230. In this case, no protrusion is necessary because the height of the chamber 240 is defined by the length of the legs 255*a*, 255*b*.

Further as is already shown in FIG. 4*a*, the connection between the insert 250 and the wall of the recess may be sealed by seals 265. These seals may be made of a non-metal material.

FIG. 7*b* shows three views of the insert 250 of FIG. 7*a* without the surrounding stationary scroll plate. The first image is a perspective view of the insert 250, while the second image is a perspective view of a cross-section of the insert 250 and the third image is a cross-sectional view of the insert 250. The insert 250 comprises first and second legs 255*a*, 255*b* for being connected to side walls of a recess in a stationary scroll plate and two protrusions 260, which are used for defining the height of the cooling chamber. As can be seen in FIG. 7*b*, the insert has an annular shape and is configured for being placed in an annular recess in a stationary scroll plate.

FIGS. 8*a* to 8*c* show a cross-sectional views of some embodiments of an orbiting scroll plate, which can be used in conjunction to the stationary scroll plate according to the current invention. In the first embodiment of a scroll plate 130*a* depicted in FIG. 8*a*, the scroll plate comprises a second base plate 400 having a first side 405 and a second side 410. The first side comprises a spiral wrap 470 and may also be referred to as frontside. The second side comprises a second recess 420 located at the surface of the second side, which has an annular shape, such that it occurs on the left and right image sides of the surface. A more detailed example of an annular recess will be described below with respect to FIG. 9*a*. Within the second recess, an insulation material (not shown) can be placed, as will be shown in more detail below with respect to FIGS. 9*a* to 9*c*.

The scroll plate 130*a* depicted in FIG. 8*a* is an orbiting scroll plate, as can be identified by the annular protrusion 440, which forms a reception for a crankshaft, as will also be described in more detail below with respect to FIG. 9*a*.

Additionally to the features of scroll plate 130*a* depicted in FIG. 8*a*, the scroll plate 130*b* depicted in FIG. 8*b* comprises an additional second recess 420*b*, which is located in the reception formed by the annular shaped protrusion 440. The person skilled in the art will appreciate that the second recess 420*b* can be used additionally to the second recess 420 as is depicted in FIG. 8*b* or alternatively to recess 420 even though this is not explicitly shown in a separate drawing.

Whereas the second recesses 420, 420*b* depicted in FIGS. 8*a* and 8*b* are located at the surface of the second side 410 of the second base plate 400, the scroll plate 130*c* depicted in FIG. 8*c* comprises second recesses 425, 425*b*, which are located beneath the surface of the second side 410. Although the second recesses 425, 425*b* in FIG. 8*c* are shown at lateral positions (with respect to the surface of the second side of second base plate of the orbiting scroll plate) corresponding to the recesses 420, 420*b* of the embodiment example depicted in FIG. 8*b*, the person skilled in the art that other shapes are also possible. For example, a single recess may extend in a plane parallel to the surface of the second base plate 400, may be annular and may have a diameter up to the extend of the second base plate.

In the embodiment examples of orbiting scroll plates depicted in FIGS. 8*a* to 8*c*, the second recesses and the insulating material are placed at the locations near the location of the protrusion for receiving a portion of the crankshaft. Although other locations for the second recess are possible and are encompassed by the scope of the current application, the exemplary locations depicted in the drawings represent preferred examples. In case of a low-pressure side and high-pressure side scroll compressor configuration, these preferred examples account for temperature differences between the first side, which experiences a temperature similar to the discharge temperature in the center of the second spiral wrap 470, and the second side, which experiences the substantially lower side temperature at the annular protrusion 240 caused by lubrication of the crankshaft with a lubricant and additionally contact with vapor at the suction side received from the suction port.

FIGS. 9*a* to 9*c* show embodiment examples of an orbiting scroll plate which can be used in conjunction with the stationary scroll plate according to the current invention, wherein (a) is a perspective view of an embodiment example of an orbiting scroll plate cut in half and (b), (c) are top views of the backside of said orbiting scroll plate. The embodiment example depicted in FIGS. 9*a* to 9*c* corresponds to the illustration depicted in FIG. 8*b*. In these FIGS. 9*a* to 9*c* the insulating materials 430 and 460 located in recess 420 and 420*b* respectively are shown. Further, because of the perspective view, the annular shape of recess 420 and the circular shape of recess 420*b* as well as the annular shape of the protrusion 440 can be more clearly identified compared to the cross-sectional views depicted in FIG. 8*b*.

In FIGS. 9*a* and 9*b*, the insulating material 430, 430*a* is represented by a ring made of insulating material being located in an annular second recess, while the insulating material 460 is represented by a circle or disc made of insulating material located in a circular recess. In contrast to insulating material 430*a* in FIG. 9*b*, the insulating material 430*b* in FIG. 9*c* does not form a closed ring. This allows the insulating material to increase or decrease its size caused by thermal effects within the insulating material. As the person skilled in the art will appreciate, this benefit may also be achieved by providing multiple portions of insulating material, which are placed in sections of the annular recess.

FIGS. 10*a*, 10*b* show another embodiment example of an orbiting scroll plate 130*b* which can be used in conjunction with a stationary scroll plate according to the current invention, wherein the second base plate consists of two parts, wherein the first part comprises the first side and the second part comprises the second side and wherein the insulating material is placed between the first part and the second part.

In this embodiment example, the second base plate of the orbiting scroll plate 130*b* is formed by a first portion 510, a second portion 520 and an insulating layer 530 placed in a second recess between the first portion 510 and the second portion 520. As such, a second recess in the sense of the current invention may also be interpreted as separation of the base plate into two portions 510 and 520. This embodiment example isolates the first portion 510 from the second portion 520 by ease of the insulating layer 530, which reduces heat transfer between both portions of the base plate of the scroll plate.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

The invention claimed is:

1. A stationary scroll plate for use in a scroll compressor, the stationary scroll plate comprising:

a base plate having a first side and a second side, wherein the second side opposes the first side;

a spiral wrap formed at the first side of the base plate, wherein the spiral wrap is adapted to interact with a corresponding spiral wrap of an orbiting scroll plate to form a compression chamber;

an injection channel formed within the base plate, the injection channel providing an injection path for injection of fluid into the compression chamber;

a recess located at the second side, wherein the recess is configured to form an intermediate pressure cavity that comprises a connection to an opening in the base plate arranged within the spiral wrap;

an insert placed within the recess, wherein the insert separates a volume within the recess into-forms a cooling chamber within the recess and a remaining volume for forming the intermediate pressure cavity;

an inlet channel via which the cooling chamber is connected to the injection channel; and an outlet channel via which the cooling chamber is connected to the inside of the spiral wrap.

2. The stationary scroll plate according to claim 1, wherein the recess located at the second side has an annular shape and wherein the insert placed within the recess forms the cooling chamber in at least a portion of the annular recess.

3. The stationary scroll plate according to any claim 1, wherein the cooling chamber, the inlet channel and the outlet channel define a cooling path configured to guide fluid from the injection channel to the inside of the spiral wrap.

4. The stationary scroll plate according to claim 1, wherein the recess comprises a bottom and two side walls and wherein a sealed contact is established between the insert and both side walls.

5. The stationary scroll plate according to claim 4, wherein the insert comprises at least one protruding element, which contacts the bottom of the recess and thereby defines a height of the cooling chamber.

6. The stationary scroll plate according to claim 4, wherein the insert comprises legs, which establish the sealed connection with the side walls.

7. The stationary scroll plate according to claim 1, wherein the insert is made of steel, cast iron or a non-metal material.

8. A scroll compressor comprising a stationary scroll plate according to claim 1.

9. The scroll compressor according to claim 8, further comprising:

an orbiting scroll plate, wherein the orbiting scroll plate comprises:

a second base plate having a frontside and a backside, wherein the backside opposes the frontside; and a second spiral wrap formed on the frontside of the base plate;

wherein the base plate comprises one or more second recesses and wherein an insulating material is located in at least one of the one or more second recesses of the orbiting scroll plate.

10. The scroll compressor according to claim 9, wherein at least one of the one or more second recesses of the orbiting scroll plate is located at a surface of the backside of the second base plate.

11. The scroll compressor according to claim 9, wherein at least one recess of the one or more second recesses is located beneath the surface of the backside of the base plate.

12. The scroll compressor according to claim 11, wherein the at least one second recess beneath the surface of the backside is formed as a sealed chamber within the second base plate.

13. The scroll compressor according to claim 12, wherein the insulating material located in the at least one second recess beneath the surface of the backside of the second base plate is a fluid.

14. The scroll compressor according to claim 9, wherein the insulating material forms a layer located between the frontside and the backside of the second base plate.

15. The scroll compressor according to claim 9, wherein the insulating material located in the second recess is a non-metal material having a low thermal conductivity.

* * * * *